US005870070A

United States Patent [19]

Furukawa et al.

[11] Patent Number: 5,870,070

[45] Date of Patent: Feb. 9, 1999

[54] LIQUID CRYSTAL DISPLAY DEVICE AND METHOD FOR DRIVING DISPLAY DEVICE

[75] Inventors: Hiroyuki Furukawa, Ueno; Shinya Takahashi, Yamatokoriyama; Kunihiko Yamamoto, Kashiba, all of Japan

[73] Assignee: Sharp Kabushiki Kaisha, Osaka, Japan

[21] Appl. No.: 725,395

[22] Filed: Oct. 3, 1996

[30] Foreign Application Priority Data

Oct. 5, 1995 [JP] Japan ..... 7-258966

[51] Int. Cl.[6] ..... G09G 3/36

[52] U.S. Cl. ..... 345/99; 345/100

[58] Field of Search ..... 345/87–100, 50–53, 345/208

[56] References Cited

U.S. PATENT DOCUMENTS

| | | | |
|---|---|---|---|
| 4,630,122 | 12/1986 | Morokawa . | |
| 4,679,043 | 7/1987 | Morokawa . | |
| 4,750,813 | 6/1988 | Ohwada et al. | 345/87 |
| 4,929,058 | 5/1990 | Numao . | |
| 5,262,881 | 11/1993 | Kuwata et al. | 345/93 |
| 5,376,944 | 12/1994 | Mogi et al. . | |
| 5,420,604 | 5/1995 | Scheffer et al. . | |
| 5,457,551 | 10/1995 | Culter et al. . | |
| 5,459,482 | 10/1995 | Orlen | 345/98 |
| 5,459,495 | 10/1995 | Scheffer et al. | 345/89 |
| 5,475,397 | 12/1995 | Saidi . | |
| 5,485,173 | 1/1996 | Scheffer et al. . | |
| 5,489,919 | 2/1996 | Kuwata et al. | 345/100 |
| 5,512,916 | 4/1996 | Merchant et al. | 345/98 |
| 5,521,727 | 5/1996 | Inaba et al. . | |
| 5,548,302 | 8/1996 | Kuwata et al. | 345/89 |
| 5,596,344 | 1/1997 | Kuwata et al. | 345/89 |
| 5,598,179 | 1/1997 | Orlen et al. | 345/98 |
| 5,644,329 | 7/1997 | Asari et al. | 345/89 |

FOREIGN PATENT DOCUMENTS

| | | |
|---|---|---|
| 0585466 A1 | 3/1994 | European Pat. Off. . |
| 0595495 A2 | 5/1994 | European Pat. Off. . |
| 5-46127 | 2/1993 | Japan . |
| 5-100642 | 4/1993 | Japan . |
| 5-143019 | 6/1993 | Japan . |
| 5-150750 | 6/1993 | Japan . |
| 6-4049 | 1/1994 | Japan . |
| 6-51717 | 2/1994 | Japan . |
| 6-27908 | 4/1994 | Japan . |
| 6-67626 | 11/1994 | Japan . |
| 2280980 | 2/1995 | United Kingdom . |

OTHER PUBLICATIONS

Nehring et al, "Ultimate Limits for Matrix Addressing of RMS–Responding Liquid–Crystal Displays", IEEE Transactions on Electron Devices, vol. ED–26, No. 5, May 1979, pp. 795–802.

(List continued on next page.)

*Primary Examiner*—Steven Saras
*Assistant Examiner*—David L. Lewis
*Attorney, Agent, or Firm*—Nixon & Vanderhye, P.C.

[57] ABSTRACT

A method for driving a simple matrix type display device includes the steps of: applying a data voltage corresponding to values obtained by an orthogonal transform of input data to the data electrodes; applying a scanning voltage to the scanning electrodes, the scanning voltage corresponding to an orthogonal function used for the orthogonal transform; and reproducing the input data by an orthogonal inverse transform of the data voltage on the display panel, wherein the step of applying the scanning voltage includes the steps of: applying a scanning selection pulse signal having at least two levels to the scanning electrodes as a scanning voltage; and fixing the scanning selection pulse signal to an unselected level during a first period, a second period, or both of the first and second periods, the first period being defined as a period from the beginning of the data output until a predetermined time later in a data voltage output period, and the second period being defined as a period from a predetermined short time before the completion of the data output until the completion of the data output in the data voltage output period.

17 Claims, 9 Drawing Sheets

OTHER PUBLICATIONS

Ruckmongathan, "Addressing Techniques for RMS Responding LCDs–A Review", Japan Display '92, pp. 77–80, 1992.

Kudo et al, "Study on Driving Methods for Fast–Responding STN–LSDs" Technical Report of IEICE, EID94–129, ED94–157, SDM94–186, pp. 13–18, 1995.

Scheffer et al, "13/4: Active Addressing Method for High–Contrast Video–Rate STN Displays", SID 92 Digest, pp. 228–231, 1992.

Ruckmongathan et al, "S3–4 A New Addressing Technique for Fast Responding STN LCDs", Japan Display '92, pp. 65–68, 1992.

Ruckmongathan, "A Generalized Addressing Technique for RMS Responding Matrix LCDs", 1988 International Display Research Conference, pp. 80–85, 1988.

FIG. 1A $$\begin{bmatrix} 1 & 1 & 1 & 1 \\ 1 & -1 & 1 & -1 \\ 1 & 1 & -1 & -1 \\ 1 & -1 & -1 & 1 \end{bmatrix}$$

AA method

PRIOR ART

FIG. 1B $$\begin{bmatrix} 1 & 0 & 1 & 0 \\ 1 & 0 & -1 & 0 \\ 0 & 1 & 0 & 1 \\ 0 & 1 & 0 & -1 \end{bmatrix}$$

Dispersion MLS method

PRIOR ART

FIG. 1C $$\begin{bmatrix} 1 & 1 & 0 & 0 \\ 1 & -1 & 0 & 0 \\ 0 & 0 & 1 & 1 \\ 0 & 0 & 1 & -1 \end{bmatrix}$$

( Non-disperation MLS method

PRIOR ART

FIG. 2

$$\begin{array}{cccccccccc} \begin{bmatrix} 1 & 0 & 0 & 0 & 1 & 0 & 0 & 0 \\ 1 & 0 & 0 & 0 & -1 & 0 & 0 & 0 \\ 0 & 1 & 0 & 0 & 0 & 1 & 0 & 0 \\ 0 & 1 & 0 & 0 & 0 & -1 & 0 & 0 \\ 0 & 0 & 1 & 0 & 0 & 0 & 1 & 0 \\ 0 & 0 & 1 & 0 & 0 & 0 & -1 & 0 \\ 0 & 0 & 0 & 1 & 0 & 0 & 0 & 1 \\ 0 & 0 & 0 & 1 & 0 & 0 & 0 & -1 \end{bmatrix} & \begin{array}{c} S1 \\ S2 \\ S3 \\ S4 \\ S5 \\ S6 \\ S7 \\ S8 \end{array} & \begin{array}{c} \text{Scan} \\ \downarrow \\ \\ \\ \\ \\ \\ \\ \end{array} \\ \begin{array}{cccccccc} t1 & t2 & t3 & t4 & t5 & t6 & t7 & t8 \end{array} & \rightarrow \text{Time} & \end{array}$$

PRIOR ART

PRIOR ART

PRIOR ART

PRIOR ART

PRIOR ART

PRIOR ART

LIQUID CRYSTAL DISPLAY DEVICE AND METHOD FOR DRIVING DISPLAY DEVICE

BACKGROUND OF THE INVENTION

1. FIELD OF THE INVENTION

The present invention relates to a liquid crystal display device and to a method for driving a display device. In particular, the present invention relates to a driving circuit for generating a driving waveform that provides uniform display quality and peripheral circuitry thereof.

2. DESCRIPTION OF THE RELATED ART

In recent years, there has been increasing demand for display devices capable of displaying a large amount of information at the same time due to the rise of a highly information-oriented society. CRT (Cathode Ray Tubes) displays have conventionally been used for such purposes. However, CRTs are generally large and tend to consume a large amount of power, making them unsuitable for use other than as desk-top devices. On the other hand, flat display devices such as LC (liquid crystal) display devices are attracting much attention because of their thinness and light weight.

LC display devices were originally developed as display devices for calculators, watches, etc. However, current LC display devices typically include a matrix of scanning electrodes and data electrodes, and are capable of displaying images on a large screen owing to progress in technology concerning STN (Super-Twisted Nematic) liquid crystal and TFT (Thin Film Transistor) elements.

Such matrix type LC display devices can be classified into simple matrix type display devices and active matrix type display devices in terms of their driving methods.

Active matrix type LC display devices, which are typically driven by using TFT elements or MIM (Metal Insulator Metal) elements, include a matrix of scanning electrodes and data electrodes with switching elements of TFTs, diodes, and the like located at the respective intersections of the scanning and data electrodes. A display is realized by controlling such switching elements so as to apply a voltage independently to portions of liquid crystal corresponding to the respective pixels. In such active matrix type LC display devices, the LC is usually driven in its TN (Twisted Nematic) mode, thereby achieving high contrast and a quick response at the same time. Since the voltage to be applied to each portion of LC corresponding to a pixel can be independently controlled, it is relatively easy to display intermediate gray scale tones.

On the other hand, a typical simple matrix type LC display device driven in a STN mode includes an LC layer interposed between glass substrates having a matrix of electrodes formed on the surface thereof so as to conduct display by utilizing the steep characteristics of the electrooptical effects of LC, i.e., the change in the optical characteristics of LC when an electric field is applied thereto. As a result, simple matrix type LC display devices require a relatively simple panel structure and production process, and therefore are more preferable in terms of cost than active matrix type LC display devices.

Simple matrix type STN LC display panels have conventionally been driven by a time-divided method (or "duty driving") which is also referred to as a linearly sequential driving method. Since a plurality of pixels are coupled to one electrode in an active matrix type LC display device, the applied voltage has time-divided pulses. Generally, scanning electrodes are linearly sequentially scanned at a frame cycle of 20 ms or less. A large selection pulse is applied to each scanning electrode once per frame, in synchronization with which a data signal is applied via a data electrode.

Since conventional STN LC display devices have a relatively low LC response speed, e.g., 300 ms, the LC can respond in accordance with the ON/OFF ratio of the effective voltage applied in linearly sequential driving, thereby achieving a practical contrast level. However, once quick response is realized in STN LC display devices (such that moving images can be displayed thereby) by reducing the viscosity of LC and/or reducing the thickness of the LC layer, etc., the linearly sequential driving results in a noticeable degradation of contrast due to a so-called frame response phenomenon described below.

Liquid crystal is generally considered to respond to the effective values (rms) of the driving waveform. Assuming that an effective voltage of $V_{on}$ (rms) is applied to a selected electrode and an effective voltage of $V_{off}$ (rms) is applied to an unselected electrode, a driving margin ($V_{on}$ (rms) / $V_{off}$ (rms)) takes the maximum value:

$$\frac{V\text{on(rms)}}{V\text{off(rms)}} = \sqrt{\frac{\sqrt{N}+1}{\sqrt{N}-1}} \tag{1}$$

based on the voltage averaging method. In the above equation, N represents the number of scanning lines, and 1/N represents the duty ratio. Usually $V_{off}$ is set equal to a threshold voltage $V_{th}$ of the LC.

A liquid crystal panel having very quick response tends to deviate from such an inherent response mode (i.e., responding to effective values(rms)) and instead responds to the driving waveform itself, so that the transmittance value fluctuates corresponding to each frame. This phenomenon is referred to as a "frame response phenomenon".

Because of the frame response phenomenon, the off-transmittance increases even if the $V_{off}$ (for the unselected pixels) is set equal to $V_{th}$. In the selected pixels, the actual transmittance is reduced although the optimum effective voltage of $V_{on}$ (rms) is being applied. Thus, the conventional linearly sequential driving method, when applied to a high-speed STN LC panel, can remarkably deteriorate the display contrast thereof.

Therefore, in order to maintain the optical contrast in a high-speed and high-resolution STN LC panel, it is necessary to drive the LC so as to suppress the frame response phenomenon.

On the other hand, a driving method called a multiple scanning line simultaneous selection driving method (also referred to as "active driving") has been proposed, which generates scanning selection pulses from an orthogonal matrix. By the active driving method, a plurality of scanning lines are simultaneously selected during one frame period in order to control the frame response phenomenon, thereby supplying a number of small scanning selection pulses for one scanning electrode during each frame period. Thus, the active driving method utilizes the cumulative response effect of LC so as to reconcile rapid response and high contrast.

According to the active driving method, input image data is subjected to an orthogonal transform process using an orthogonal matrix, and a signal corresponding to the transformed data is supplied from the data electrode side. From the scanning electrode side, scanning voltage pulses are applied corresponding to the elements of column vectors of the orthogonal matrix used for the transform. An orthogonal inverse transform performed on the panel side for the input image data reproduces the input image.

Active driving methods can be generally classified into an active addressing method (hereinafter referred to as the "AA method") and a multiline selection method (hereinafter referred to as the "MLS method"), although both are based on the same principle. For detailed descriptions of the AA method, see T. J. Scheffer, et al., SID' 92, Digest, p.228; Japanese Laid-Open Patent Publication No. 5-100642; and the like. For detailed descriptions of the MLS method, see T. N. Ruchmongathan et al., Japan Display 92, Digest, pp.65–68, Japanese Laid-Open Patent Publication No. 5-46127, and the like.

FIGS. 1A to 1C show examples of respective orthogonal functions used for the AA method and two variants of the MLS method.

The AA method uses an orthogonal function such as the WALSH function shown in FIG. 1A. Positive or negative voltages (i.e., voltages corresponding to the elements [1] or [−1] of the orthogonal matrix) are simultaneously applied to all of the scanning electrodes.

The MLS method, as in the conventional duty driving method, has unselected periods of scanning pulses. The elements [0] in the orthogonal matrices shown in FIGS. 1B and 1C correspond to the unselected periods. The MLS method has an advantage of using mathematical operations of a much smaller scale than the AA method because when an element of the matrix is [0], the result of an orthogonal transform with given data (i.e., multiplication/addition) always becomes 0.

The MLS method is further classified into a dispersion MLS method (FIG. 1B) in which the selection pulses of the orthogonal function are dispersed through-out one frame period, and a non-dispersion MLS method (FIG. 1C) in which selection pulses of the orthogonal function are grouped into blocks. An example of the dispersion MLS method is a SAT (Sequency Addressing Technique) disclosed in Japanese Laid-Open Patent Publication No. 6-4049. An example of the non-dispersion MLS method is an IHAT (Improved Hybrid Addressing Technique) disclosed in T. N. Ruchmongathan et al., IDRC 1988 pp.80–85.

An intrablock dispersion MLS method (Japanese Patent Application No. 6-291848), in which the selection pulses are dispersed within each of a plurality of blocks into which one frame is divided, is classified as a non-dispersion MLS method in terms of its fundamental operation sequence, and therefore requires a smaller memory capacity than does the dispersion MLS method. However, hereinafter the intrablock dispersion MLS method and the dispersion MLS method will be collectively referred to as "the dispersion MLS method" because the intrablock dispersion MLS method is capable of reducing the number of simultaneously selected lines to that required by the dispersion MLS method.

In general, the dispersion MLS method is considered to provide the same effect, by using a smaller number of selected lines, as that of the non-dispersion MLS method. In fact, an experiment in which a VGA-class LC panel having a response speed of 150 ms was driven while being split into upper and lower halves so as to display an image at a frame frequency of 60 Hz showed that the dispersion MLS method only requires 7–15 lines to be simultaneously selected in order to attain the same contrast level as that attained by the AA method, which selects all of the 240 scanning lines. On the other hand, the non-dispersion MLS method required 60 or more lines to be simultaneously selected in order to attain the above-mentioned contrast level.

However, the memory capacity required for the orthogonal transform operation depends on the calculation order of the orthogonal transform operation, i.e., the specific orthogonal transform matrix chosen. Thus, the non-dispersion MLS method has an advantage in that it only requires a memory capacity corresponding to the number of selected lines, whereas the AA method and the dispersion MLS method fundamentally require a memory capacity for storing data corresponding to at least one entire frame. Therefore, neither the dispersion MLS method nor the non-dispersion MLS method is superior.

However, when contemplating a system which primarily aims to maintain a satisfactory contrast level, a smaller operation scale is desirable because it leads to lower power consumption. Therefore, the dispersion MLS method is considered the most practical among the various active driving methods for rapid STN LC panels.

As described above, among the various active driving methods for high-speed STN LC panels, the dispersion MLS method is considered to have the optimum balance between the contrast level and circuit scale.

However, the inventors discovered upon driving a high-speed STN LC panel by the dispersion MLS method, that the dispersion MLS method has problems unique to itself, e.g., degradation in display quality such as a double-image (ghost) phenomenon and display unevenness occurring in a horizontal zone as described below. These problems do not belong to the duty driving method.

The above-mentioned problems are ascribed to nothing but the operation principle of the dispersion MLS method, i.e., all the scanning lines are divided by the number of selected lines into a plurality of subgroups in such a manner that the scanning selection waveform is dispersed within each subgroup, as described below.

FIG. 2 shows an exemplary orthogonal function matrix used for the dispersion MLS method. In this case, there is a total of 8 scanning lines to be selected, two of which are simultaneously selected, and there are 8 data electrodes. In theory, the elements [+1] and [−1] of the orthogonal matrix correspond to scanning selection pulse potentials $+V_r$ and $-V_r$, respectively, and the element [0] of the orthogonal matrix corresponds to a unselected potential $V_{com}$ (=0). Data shown in FIG. 3 is to be displayed by using the orthogonal function in FIG. 2. FIG. 4 shows the waveform of pulses to be applied to the scanning electrodes by a common driver IC on the scanning side for driving the LC.

In an actual LC panel module, the electrode resistance of the scanning electrodes e.g., those of ITO (Indium Tin Oxide), the ON resistance of the scanning-side driver IC, and the capacitance component of the LC itself form a low-pass filter, which cuts off the harmonics components contained in the steep rises and steep falls of the scanning pulses. As a result, the waveform of the voltage to be applied to the scanning electrodes is distorted (or blunted) as shown in FIG. 5 in actual operation.

Among the distortions of the waveform of scanning selection pulses, the distortion occurring at the foot of the falling edge of each pulse, which causes some degradation in the display quality, will be first described.

When such distortion occurs, the fall of the $+V_r$ pulse (or the rise of the $-V_r$ pulse) has some delay so that each scanning selection pulse is applied to the same scanning electrode for a period slightly longer than the intended period, as shown in FIG. 5.

With respect to the scanning electrodes S1 and S2, the first selection pulse in one frame is to be applied during a period t1. However, the above-mentioned distortion of the scanning selection pulse waveform is applied as a secondary selection pulse to the scanning electrodes S1 and S2 for a period of Δt in addition to the period t1. The period Δt exists within a period t2, during which a selection pulse is to be applied to the next scanning electrodes S3 and S4.

In other words, a data signal from the segment side is applied (as ON voltage) to portions of the LC corresponding to the scanning electrodes S1 and S2 during not only the intended period t1 but also the period Δt within the period t2, during which the selection pulse is to be applied to the scanning electrodes S3 and S4. As a result, the image data to be reproduced at positions corresponding to the scanning electrodes S3 and S4 are reproduced so as to be slightly visible at positions corresponding to the scanning electrodes S1 and S2, thus creating a ghost image. In summary, any waveform distortion occurring at the falling edge of a pulse allows an image which should be reproduced only under a selected number of scanning electrodes to be also reproduced under adjoining scanning electrodes, thereby resulting in a ghost or a faint image of the same pattern appearing at a position slightly shifted from the original image.

It may seem that the scanning electrodes S7 and S8 are free from the ghost phenomenon because they are located at the end of the 8 scanning electrodes, and also physically at an end of the LC panel. However, since the waveform distortion of the scanning selection pulse to be applied to the scanning electrodes S7 and S8 exists within the period during which the scanning electrodes S1 and S2 are selected, the image data to be reproduced at positions corresponding to the scanning electrodes S1 and S2 appear as a ghost at positions corresponding to the scanning electrodes S7 and S8. However, when the scanning goes back from the scanning electrodes S7 and S8 to the scanning electrodes S1 and S2, the function data (i.e., the orthogonal function) changes so that not just a simple ghost of the image to be reproduced at the scanning electrodes S1 and S2 but a reversed image (i.e., white portions appearing black and vice versa) of the ghost often appears at the scanning electrodes S7 and S8.

As a result, the display device data of FIG. 3 is likely to appear as in FIG. 6.

In the case of the duty driving method, scanning electrodes are sequentially selected one by one, so that the ghost of an image to be reproduced at the intended scanning electrodes, occurring due to waveform distortion at the falling edge of the scanning selection pulse, appears in principle at scanning electrodes next to the intended scanning electrodes, rather than at a position substantially away from the intended scanning electrodes as in the case of the active driving method. Moreover, the duty driving method selects a scanning electrode only once in every frame, so that any waveform distortion of a scanning selection pulse within one frame has a smaller influence than in the case of the active driving method, which selects a scanning electrode a plurality of times in every frame. Furthermore, the duty driving method is typically adopted for a low-speed panel, which has a thicker LC layer than that of a high-speed panel, that is, the capacitance component is smaller than in the case of a high-speed panel. Therefore, the influence of waveform distortion becomes even smaller. Thus, the double-image phenomenon of an original image being accompanied by a ghost image is not as prominent in the duty driving as in the active driving.

Next, the degradation in display quality due to waveform distortion occurring at the rising edge of a pulse will be described. The following description illustrates a case where the data signal is intended for displaying an all-white image.

When an orthogonal transform is performed for a normally-black LC panel by a binary digital system, white data corresponds to "1" (i.e., High) and black data corresponds to "0" (i.e., Low). Elements [+1] and [−1] correspond to "1" (i.e., High) and "0" (i.e., Low), respectively.

An orthogonal operation by this system is performed by taking an Exclusive OR of each column vector of the data and the function, and adding the results of the Exclusive ORs by an adder, the result of the addition defining a data signal corresponding to display data (i.e., a signal to be applied to the data electrodes). Accordingly, it is presumable that the operation result has a large dependence on the function when the data is all-white, i.e., all "1" (High).

Now a case will be contemplated where the orthogonal function matrix in FIG. 2 is used for an LC panel system composed of 8 scanning electrodes and 8 data electrodes (as in the above description of the double-image phenomenon). Herein, the display data is assumed to be all-white. The signal waveform on the data side of the circuitry in this case is constant irrespective of the data electrodes, as shown in FIG. 7. As seen from FIG. 7, the data signal waveform drastically varies only at a boundary between the period t4 and the period t5, at which the orthogonal function changes.

In the duty driving method and the MLS methods, unselected periods are predominant in the scanning signal waveform for every frame. Therefore, the change in the data signal on the segment side is induced to the common side, thereby appearing as an induction distortion in the waveform of the scanning signal.

In this exemplary case, the data signal changes only once in one frame, i.e., at the boundary between the periods t4 and t5 as shown in FIG. 8, and therefore does not cause induction distortion in any other periods in the frame. In other words, among scanning selection pulses, only the rise of the selection pulse applied to the scanning electrode S1 during the period t5 and the fall of the selection pulse applied to the scanning electrode S2 during the period t5 are influenced by the induction from the segment side (data electrodes).

Specifically, the selection pulse voltage for the scanning electrode S1 has a small amount of waveform distortion relative to the distortion of selection pulses for the scanning electrodes S3 to S8, whereas the selection pulse voltage for the scanning electrode S2 has a large amount of distortion relative to the waveform distortion of the selection pulses for the scanning electrodes S3 to S8. However, the scanning selection pulses for scanning electrodes other than the scanning electrodes S1 and S2 are not influenced by the induction from the segment side. For similar reasons, the selection pulse voltage level for the scanning electrodes S1 and S2 largely decreases at the beginning of the period t1 due to waveform distortion.

As a result, the waveform distortion occurring at the rising edge of the scanning selection pulses for the scanning electrodes S1 and S2 in the periods t1 and t5 is different (i.e., more or less drastic) from the waveform distortion occurring at the rising edge of the other scanning selection pulses. Therefore, the effective values of the applied voltages to the pixels (LC) corresponding to the scanning electrodes S1 and S2 become smaller than the effective values of the voltages applied to the pixels (LC) corresponding to other scanning electrodes.

Because of the difference between the effective voltages corresponding to the scanning electrodes S1 and S2 and the effective voltages corresponding to the scanning electrodes S3 to S8, the illuminance of a portion corresponding to the scanning electrodes S3 to S8 is lower than the illuminance of portions corresponding to the other scanning electrodes, thereby resulting in a horizontal zone (corresponding to the two scanning electrodes) of uneven or reduced illuminance. In summary, any difference between the waveform distortion at the rising edge of a scanning selection pulse corresponding to a point of change in the orthogonal function and the waveform distortion at other portions of the orthogonal function results in a horizontal zone (corresponding to the number of selected scanning electrodes) of unevenness in illuminance.

Although the effective values of the voltages applied to the pixels corresponding to the scanning electrodes S1 and S2 are different from each other in the above description, they become substantially equal in actual driving because of processes such as averaging the frequency of scanning selection pulses and rotation of the orthogonal function for cancelling the DC component.

Because of the above-mentioned difference in the waveform distortion at the rising edge of each scanning selection pulse and because of the waveform distortion at the falling edge of the scanning selection pulse, a zone of display unevenness as shown in FIG. 9B is observed when the image data shown in FIG. 9A is displayed on a display panel of 8×8 display pixels by using the orthogonal function of FIG. 2.

Thus, the dispersion MLS driving method has the above-mentioned problem of display unevenness due to the operation principle thereof, i.e., all the scanning lines are divided by the number of selected lines into a plurality of subgroups in such a manner that the scanning selection waveform is dispersed within each subgroup.

SUMMARY OF THE INVENTION

In one aspect, the present invention provides a method for driving a simple matrix type display device including a display panel having a plurality of scanning electrodes and a plurality of data electrodes intersecting each other, and a matrix of pixels located at the respective intersections of the plurality of scanning electrodes and the plurality of data electrodes, the method including the steps of: applying a data voltage to the plurality of data electrodes, the data voltage corresponding to values obtained by performing an orthogonal transform of input data; applying a scanning voltage to the scanning electrodes, the scanning voltage corresponding to an orthogonal function used for the orthogonal transform; and reproducing the input data by performing an orthogonal inverse transform of the data voltage on the display panel, wherein the step of applying the scanning voltage includes the steps of: applying a scanning selection pulse signal which has at least two levels to the plurality of scanning electrodes as a scanning voltage; and fixing the scanning selection pulse signal to an unselected level during a first period, a second period, or both of the first and second periods, the first period being defined as a period from the beginning of the output of the data until a predetermined time later in a data voltage output period during which the data voltage is output to the plurality of data electrodes, and the second period being defined as a period from a predetermined short time before the completion of the output of data until the completion of the output of data in the data voltage output period.

In another aspect, the present invention provides a liquid crystal display device including: a display panel having a plurality of scanning electrodes and a plurality of data electrodes intersecting each other and a matrix of pixels located at the respective intersections of the plurality of scanning electrodes and the plurality of data electrodes; a data driver for applying a data voltage to the plurality of data electrodes, the data voltage corresponding to values obtained by performing an orthogonal transform of input data; a scanning driver for applying a scanning voltage to the plurality of scanning electrodes, the scanning voltage corresponding to an orthogonal function used for the orthogonal transform; and a timing control circuit for receiving a synchronization signal which defines timing of outputting the data voltage from the data driver and for outputting a control signal which fixes the potential level of the scanning electrode at an unselected level during a first period, a second period, or both of the first and second periods, the first period being defined as a period from the beginning of the output of data until a predetermined time later in a data voltage output period which is determined by the synchronization signal, and the second period being defined as a period from a predetermined short time before the completion of the output of data until the completion of the output of data in the data voltage output period, wherein the control signal output from the timing control circuit controls the scanning driver to output a scanning selection pulse during each data voltage output period so that a pulse width of the scanning selection pulse is shorter than the data voltage output period.

In one embodiment of the invention, the scanning selection pulse has at least two selected levels and the unselected level, and the scanning driver outputs one of the levels of the scanning selection pulse based on the orthogonal function used for the orthogonal transform, in accordance with the output timing of the corresponding data voltage from the data driver, and the scanning driver fixes the currently output scanning selection pulse to the unselected level, based on the control signal from the timing control circuit and independently of the outputting of the scanning selection pulses.

Thus, the invention described herein makes possible the advantages of (1) providing a method of driving a display device capable of preventing display quality problems inherent to the dispersion type MLS driving method, e.g., the double-image phenomenon and a horizontal zone (corresponding to the number of selected scanning electrodes) of unevenness in illuminance while conserving the advantages inherent to the dispersion type MLS driving method, e.g., high contrast obtained with relatively small-scale circuitry; and (2) providing an LC display device.

These and other advantages of the present invention will become apparent to those skilled in the art upon reading and understanding the following detailed description with reference to the accompanying figures.

BRIEF DESCRIPTION OF THE DRAWINGS

FIG. 1A shows an exemplary orthogonal function used for the AA method as a method for actively driving a simple matrix type LC display device.

FIG. 1B shows an exemplary orthogonal function used for the dispersion MLS driving method as a method for actively driving a simple matrix type LC display device.

FIG. 1C shows an exemplary orthogonal function used for the non-dispersion MLS driving method as a method for actively driving a simple matrix type LC display device.

FIG. 2 illustrates an orthogonal function used for the non-dispersion MLS method for driving a display panel of 8×8 pixels (i.e., 8 scanning lines by 8 data lines) in the case where the scanning pulses are dispersed throughout one frame period with two scanning lines simultaneously selected.

DESCRIPTION OF THE PREFERRED EMBODIMENTS

First, the principle of the present invention will be described.

According to the present invention, there is provided a simple matrix type LC display device including a plurality of scanning electrodes and a plurality of data electrodes disposed so as to intersect each other and a matrix of pixels provided so as to correspond to the intersections of the scanning electrodes and the data electrodes, in which a scanning voltage pulse is applied to a selected one of the scanning electrodes at a point in time shifted with respect to the point in time at which a data voltage is applied to the data electrodes, thereby preventing the display quality problems inherent to the dispersion type MLS driving method.

Figure 3:
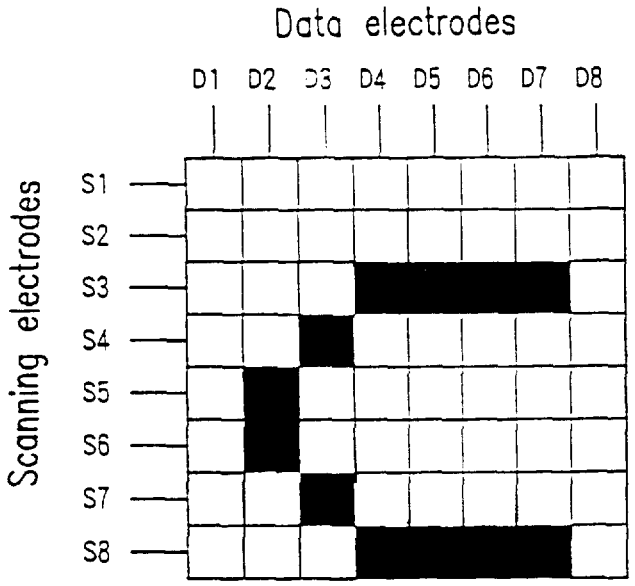
FIG. 3 shows exemplary data to be displayed on an LC panel of an LC display device.
Figure 4:
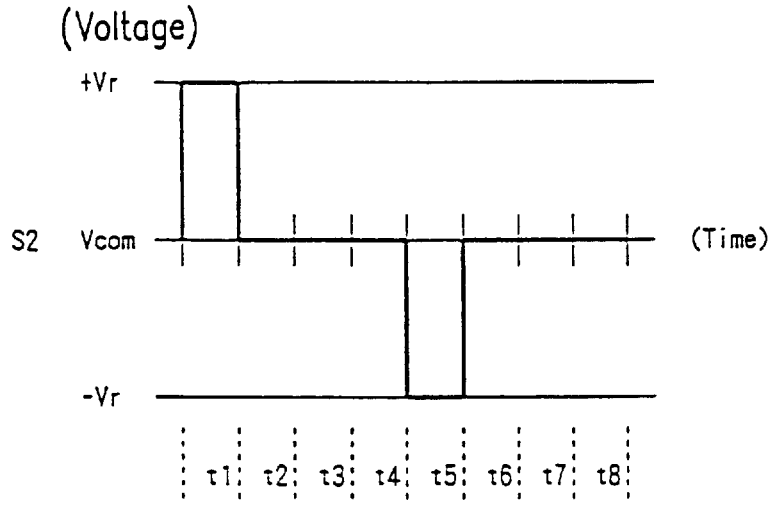
FIG. 4 is a timing diagram showing an ideal waveform of scanning pulses to be applied to an LC panel from a scanning electrode S2, based on the orthogonal function in FIG. 2.
Figure 5:
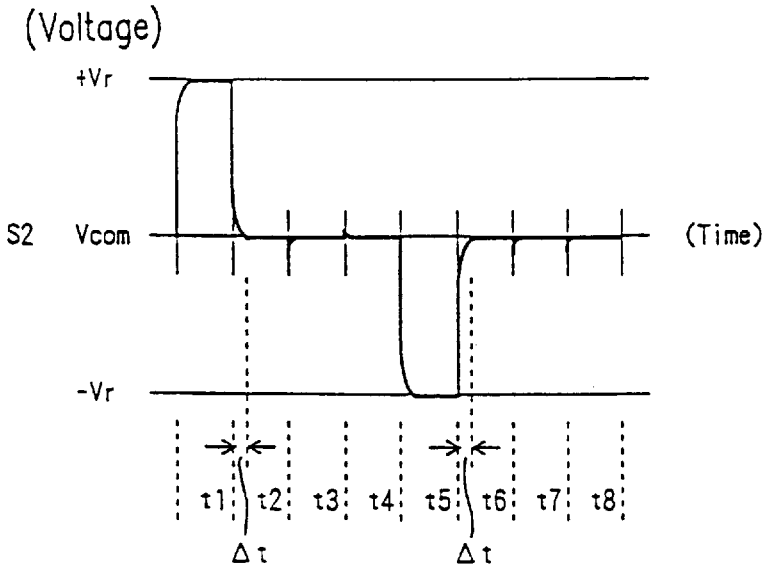
PRIOR ART FIG. 5
FIG. 5 is a timing diagram showing an actual waveform of scanning pulses applied to an LC panel from a scanning electrode S2, based on the orthogonal function in FIG. 2.
Figure 6:
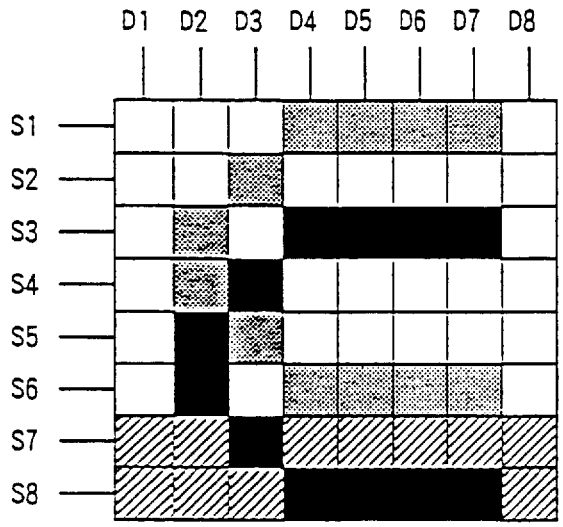
FIG. 6 illustrates an actually displayed image of the data in FIG. 3 accompanied by a ghost image.
Figure 7:
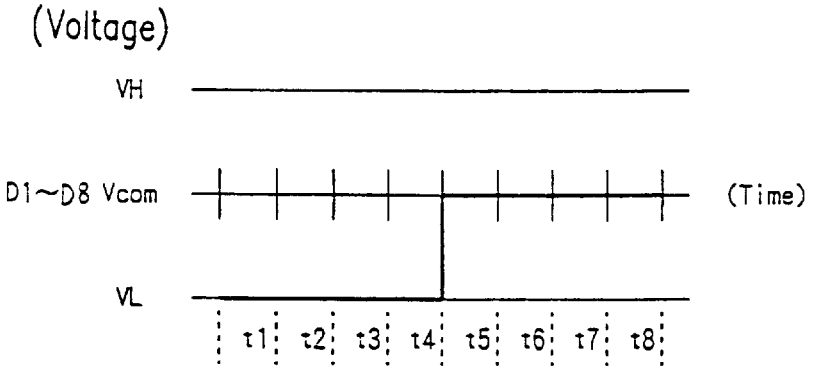
PRIOR ART FIG. 7
FIG. 7 is a timing diagram showing the waveform of a data signal voltage when displaying all-white display data using the orthogonal function in FIG. 2.
Figure 8A:
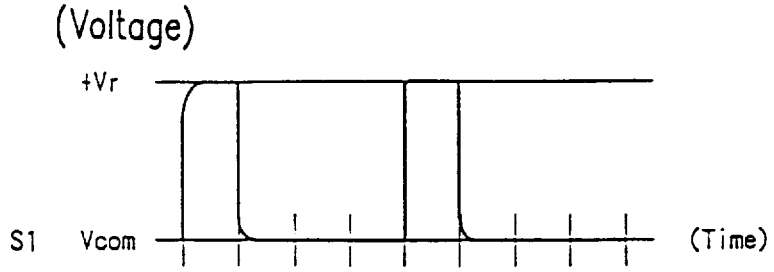
FIG. 8 is a timing diagram illustrating distortion of the waveform of a scanning selection pulse due to induction from the data signal voltage when displaying all-white display data using the orthogonal function in FIG. 2.
Figure 8B:
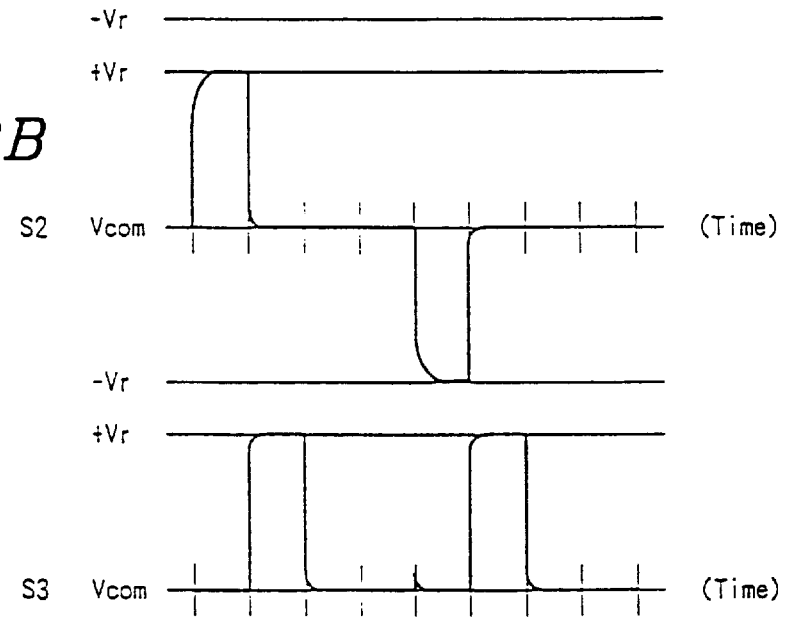
Figure 8C:
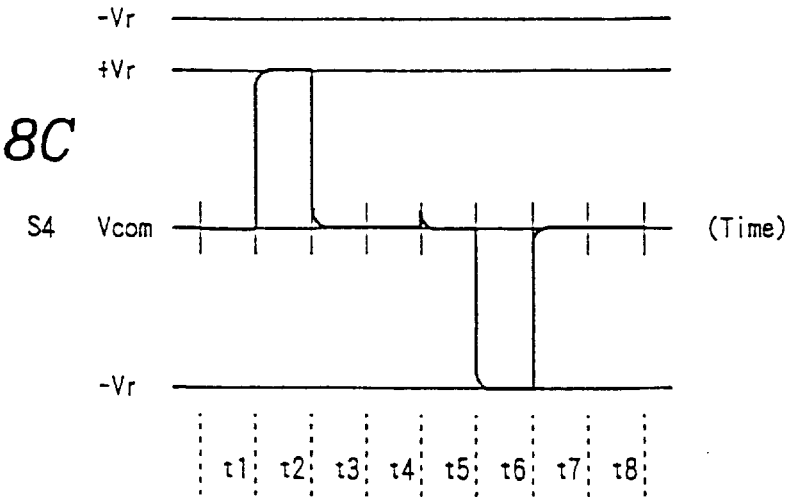
Figure 9A:
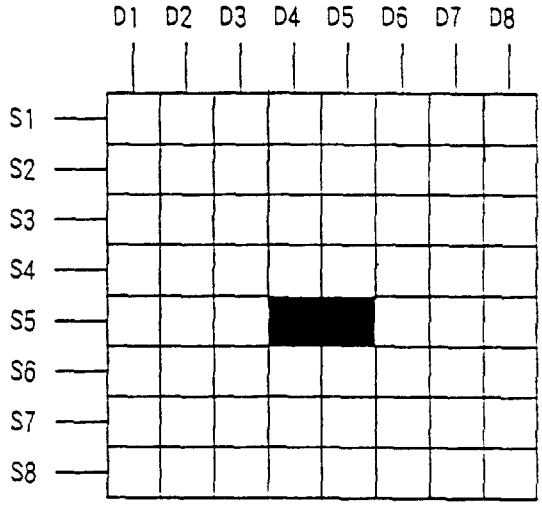
FIG. 9A illustrates an image intended to be displayed.
Figure 9B:
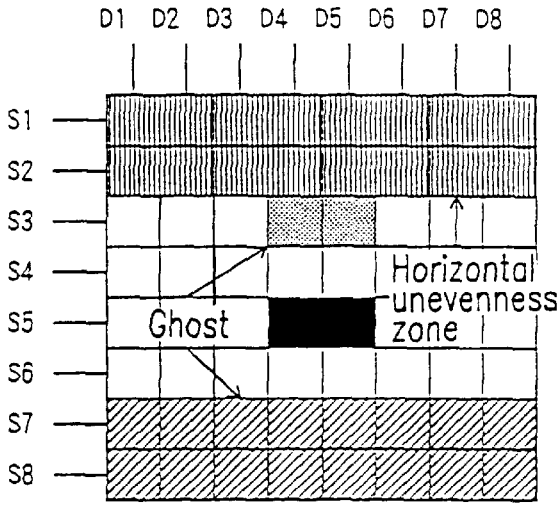
PRIOR ART FIG. 9B
FIG. 9B illustrates an image displayed using the orthogonal function in FIG. 2, accompanied by a display quality problem inherent in the dispersion MLS driving method.
Figure 10B:
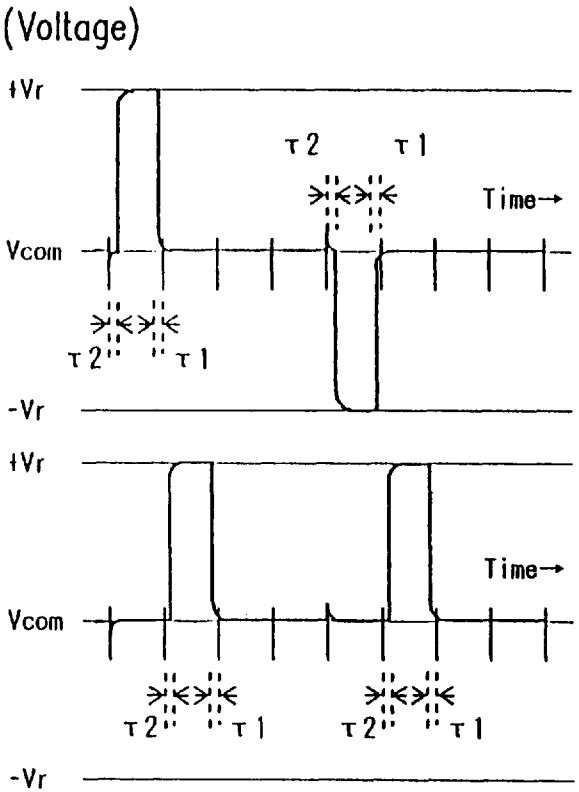
FIG. 10B shows a scanning signal waveform of a dispersion MLS driving method to which the present invention is applied.
Figure 10A:
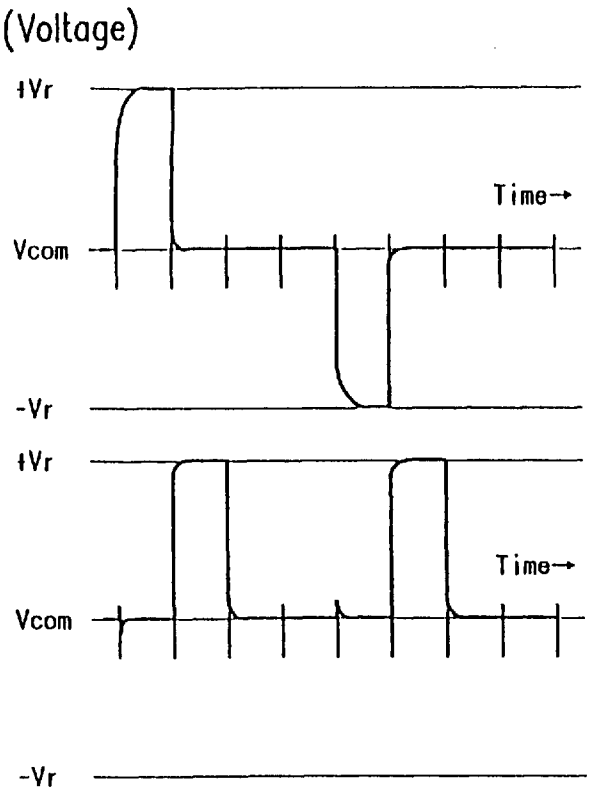
FIG. 10A shows a scanning signal waveform in a conventional dispersion MLS driving method.

FIG. 10A shows a conventional scanning signal waveform. FIG. 10B shows a scanning signal waveform according to the present invention. In FIGS. 10A and 10B, $\tau 1$ represents a time shift at the falling edge of the scanning selection pulse, and $\tau 2$ represents a time shift at the rising edge of the scanning selection pulse.

The LC display device of the present invention includes a scanning driver for sequentially outputting scanning voltage pulses to the scanning electrodes, and a timing control circuit for controlling the timing at which the scanning driver outputs scanning voltage pulses to the respective scanning electrodes.

The scanning driver is capable of outputting "selected" potentials (having two or more values) and one "unselected" potential in accordance with the timing signal for a data driver, which is supplied from an external controller, for example. Furthermore, the scanning driver is capable of fixing the current output potential at the "unselected" potential, in accordance with an output timing signal for controlling the output of the scanning voltage pulses provided from the timing control circuit, independently of the output operation of the scanning selection pulses.

The timing control circuit receives a driver latch pulse signal (which is usually equivalent to a horizontal synchronization signal) from an external controller, the latch pulse signal indicating a period (hereinafter referred to as "data output period") during which data is to be output. The timing control circuit generates a timing control signal for fixing the potential of the scanning signal from the "selected" potential to the "unselected" potential during a first period (from the point at which the output of data begins until a predetermined time later) or a second period (from a predetermined short time before the completion of the output of data until the completion of the output of data), or during both first and second periods. The first period and the second period as recited herein correspond to the time shifts $\tau 2$ and $\tau 1$, respectively, in FIG. 10B.

Specifically, the timing control circuit receives a latch pulse (i.e., a horizontal synchronization signal) from an external controller which determines a period during which the data driver outputs a predetermined voltage level (i.e., the "data output period"). The timing control circuit then generates a scanning pulse output enable signal which is activate (at a High level, for example) during a length of time excluding a short predetermined period of time immediately after the point at which the latch pulse is input, a short predetermined period of time immediately before the point at which the latch pulse is input, or both periods. The scanning pulse output enable signal is supplied to the scanning driver. The period from one latch pulse to a next latch pulse defines the data output period of the data driver.

In every horizontal synchronization period, the scanning driver sets either the "selected" voltage or the "unselected" voltage for each scanning electrode in accordance with function data supplied from an orthogonal function generator. Then, in accordance with the scanning pulse output enable signal from the timing control circuit, the scanning driver actually outputs the "selected" voltage to the selected scanning electrodes while the scanning pulse output enable signal is active, i.e., during a length of time excluding the short predetermined period of time before and/or after a latch pulse. The scanning driver outputs the "unselected" voltage to the unselected electrodes, as well as to selected electrodes during inactive periods of the scanning pulse output enable signal.

The output period of the "selected" voltage of scanning selection pulses according to the present invention is shorter than the conventional output period of the "selected" voltage, i.e., one horizontal synchronization period (or a period between one latch pulse and a next latch pulse) because the "selected" voltage is fixed to the "unselected" voltage during short periods of time within the originally "selected" time period, as described above. However, the temporary fixation of the "selected" voltage to the "unselected" voltage during the originally "selected" time period does not affect the reproduction of data because the orthogonality of the function is maintained. Although the effective value of the voltage applied to the LC may slightly be reduced during the time period(s) in which the voltage applied to the scanning electrodes is fixed at "0", this slight reduction is substantially harmless because the time period accounts for a very small portion of the horizontal synchronization period. Moreover, the data signal is subjected to an orthogonal transform using a predetermined orthogonal function, the data output voltage forms an alternating current regardless of the operation of the driving circuit of the LC display device of the invention. Therefore, no residual DC components remain to offset the data signal voltage in the LC panel.

By supplying the scanning signal voltage after the above-described process to a high-speed (rapid response) simple matrix type LC display device along with a data signal voltage, the advantages of the dispersion type MLS driving method, e.g., high contrast obtained with relatively small-scale circuitry, can be attained while preventing display quality problems inherent in the dispersion type MLS driving method, thereby obtaining a uniform and beautiful image display.

A technique for shifting the timing of the scanning selection pulse is disclosed in Japanese Laid-Open Patent Publication No. 5-150750, for example. According to this prior art technique, the falling edge of the scanning selection pulse is shifted in order to prevent induction waveform distortion in the scanning selection pulse due to a change in the voltage of the data signal. Moreover, the rising edge of the scanning selection pulse is shifted in order to prevent induction waveform distortion in the scanning selection pulse due to a change in the voltage of the data signal from the previous row. However, this prior art technique is directed to the duty driving.

On the other hand, in accordance with an LC display device of the present invention including an LC display panel driven by an active driving method such as the MLS method, a time shift is adopted at the falling edge of the scanning selection pulse so as to ensure that the scanning selection pulse (which inevitably includes some waveform distortion due to the time constant of the LC panel and the like) fits within the appropriate selected period, thereby avoiding display quality problems inherent in the active driving method, e.g., the double-image phenomenon. Moreover, in accordance with the LC display device of the present invention, a time shift is adopted at the rising edge of the scanning selection pulse so as to prevent induction from the data signal voltage from a previous subgroup in the MLS driving, thereby reducing display unevenness particularly prominent in the dispersion MLS driving method.

Hereinafter, the present invention will be described by way of examples, with reference to the accompanying figures.

(Example)

Figure 11:
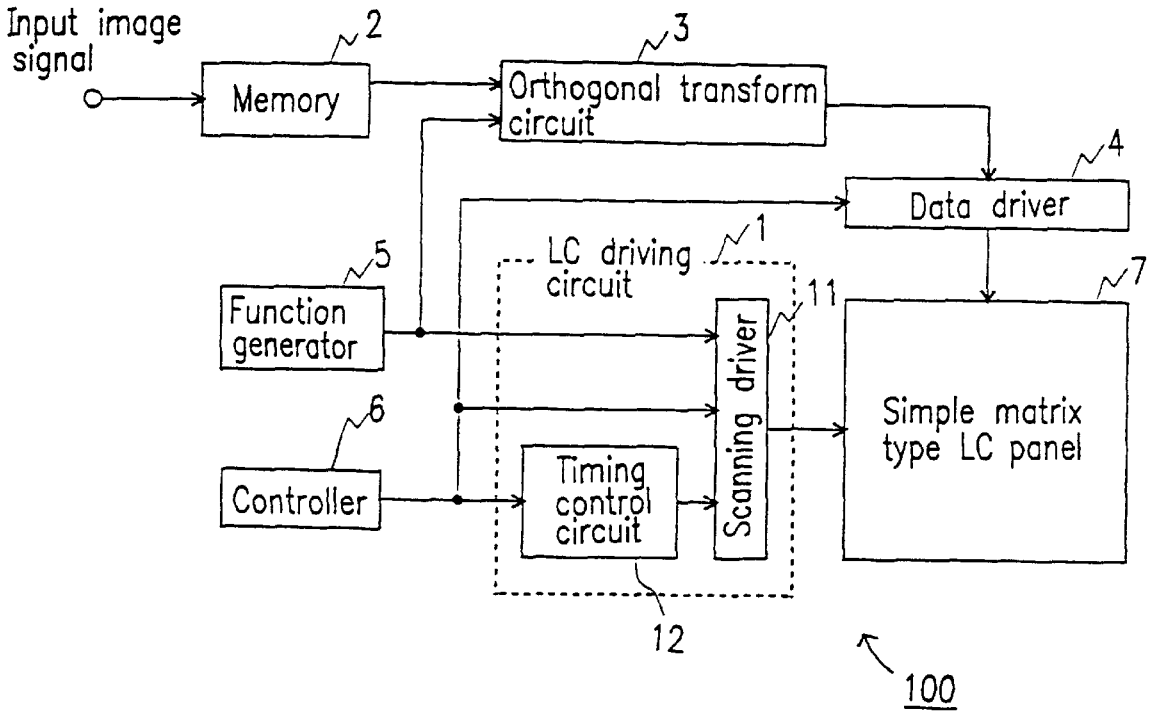
FIG. 11 is a block diagram illustrating the overall structure of an LC display device according to an example of the present invention.

FIG. 11 is a block diagram illustrating the overall structure of an LC display device 100 according to an example of the present invention.

As shown in FIG. 11, the LC display device 100 includes: a memory 2 for temporarily storing an input data signal scanned along the row direction, the input data signal being read out along the column direction in accordance with the predetermined number of simultaneously selected lines; an orthogonal transform circuit 3 for subjecting data read out from the memory 2 to an orthogonal transform; and a data driver 4 for outputting a voltage corresponding to the data signal after the orthogonal transform. The LC display device 100 further includes a scanning driver 11 for outputting scanning voltage pulses and a function generator 5 for supplying an orthogonal function to the orthogonal transform circuit 3 and the scanning driver 11. The LC display device 100 is completed by a timing control circuit 12 for controlling the scanning driver 11 by providing output timing of scanning selection voltage pulses; a data driver 4; a controller 6 for supplying a synchronization signal to the timing control circuit 12, the data driver 4, and the scanning driver 11; and an LC panel 7 of a simple matrix type. The timing control circuit 12 and the scanning driver 11 constitute an LC driving circuit 1 on the scanning side of the LC display device 100.

In the LC display device 100 having the above configuration, an externally input image signal (data signal) is written to the memory 2 along the row direction. The data is read out from the memory 2 from a plurality of rows along the column direction simultaneously. The number of rows is the same as the number of simultaneously selected lines, as in the prior art. The data read out from the memory 2 is subjected to an orthogonal transform by the orthogonal transform circuit 3 before being supplied to the data driver 4.

The function generator 5 supplies an orthogonal function for the orthogonal transform and inverse transform to the orthogonal transform circuit 3 and the scanning driver 11, respectively.

For comparison, a typical conventional structure supplies a driving voltage corresponding to the data signal (after an orthogonal transform) from the data driver 4, and a driving voltage corresponding to the orthogonal function (used for the orthogonal transform) from the scanning driver 11, to the LC panel 7 for every horizontal synchronization period, the two driving voltages being synchronized, thereby reproducing an image represented by the data signal on the LC panel 7.

On the other hand, the LC driving circuit 1 on the scanning side (including the timing control circuit 12) of the LC display device 100 of the present example operates as follows.

First, the controller 6 supplies a latch pulse as a synchronization signal to the timing control circuit 12, the data driver 4, and the scanning driver 11. The latch pulse is equivalent to a horizontal synchronization signal in principle. The drivers 4 and 11 output voltages as they receive the latch pulse.

Figure 12A:
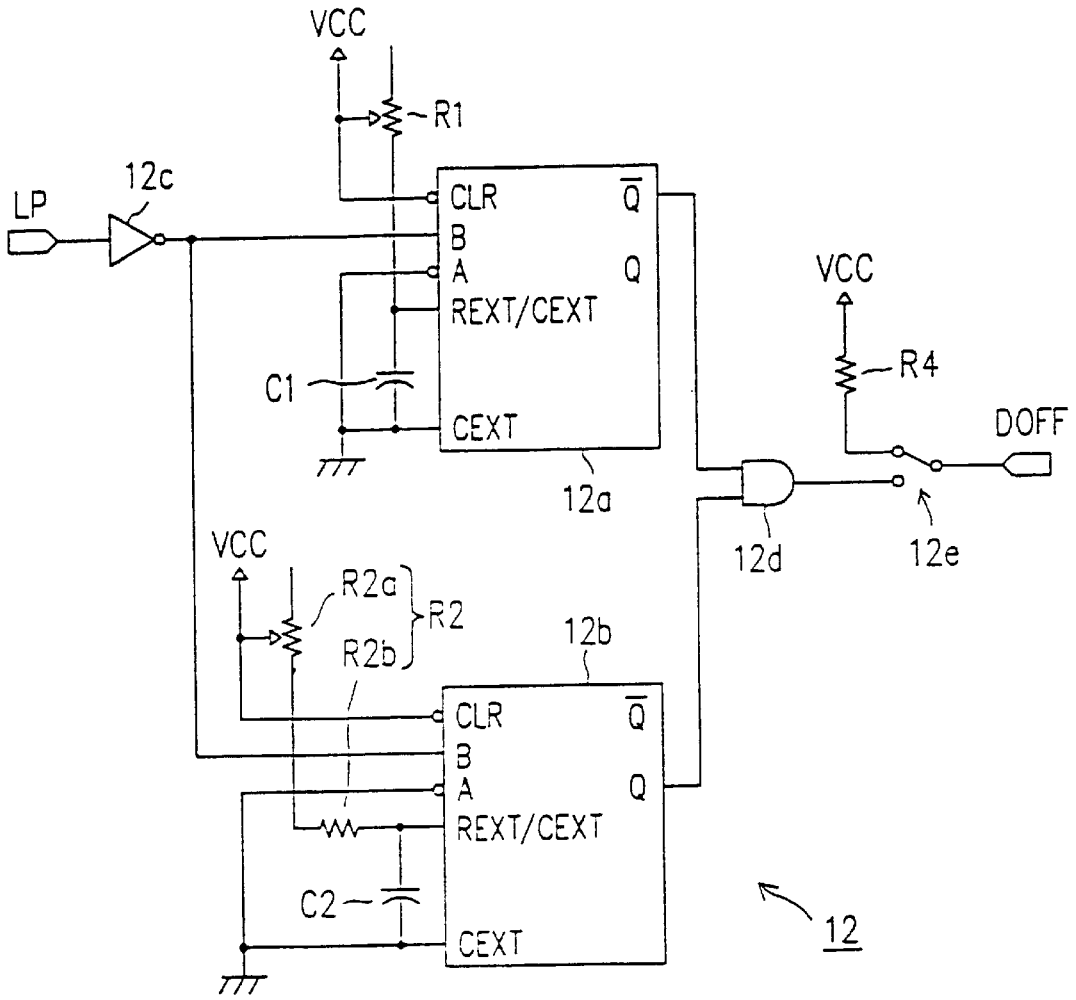
FIG. 12A shows an exemplary configuration of a timing control circuit of the LC display device according to an example of the present invention.

FIG. 12A shows an exemplary circuit configuration of the above-mentioned timing control circuit 12. The timing control circuit 12 includes an inverter 12*c* receiving the above-mentioned latch pulse LP and first and second one-shot multivibrators 12*a* and 12*b* each receiving the output of the inverter 12*c* at an input B thereof. An output $\overline{Q}$ of the first one-shot multivibrator 12*a* and an output Q of the second one-shot multivibrator 12*b* are coupled to the inputs of a two-input AND circuit 12*d*. A power level Vcc is supplied to an input CLR of the first and second one-shot multivibrator 12*a* and 12*b*. Inputs A and CEXT of the first and second one-shot multivibrator 12*a* and 12*b* are grounded. Furthermore, an input REXT/CEXT of the first one-shot multivibrator 12*a* is coupled to the power level VCC via a resistor R1, and an input REXT/CEXT of the second one-shot multivibrator 12*b* is coupled to the power level VCC via a resistor R2. A capacitor C1 is coupled between the input REXT/CEXT and the input CEXT of the first one-shot multivibrator 12*a*, and a capacitor C2 is coupled between the input REXT/CEXT and the input CEXT of the second one-shot multivibrator 12*b*. The resistor R2 is composed of a power-side resistor R2*a* and a vibrator-side resistor R2*b*. The resistors R2*a* and R1 are variable resistors.

Figure 12B:
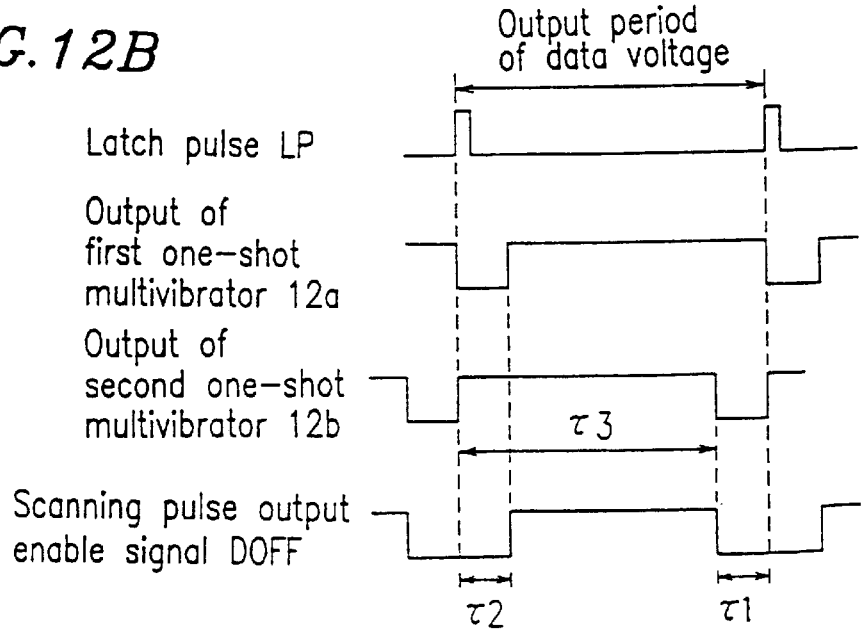
FIG. 12B is a timing diagram showing the waveform of an input (latch pulse signal LP) thereof and the waveform of an output (scanning pulse output enable signal DOFF) thereof, along with signal waveforms at internal signal nodes.

As shown in FIG. 12B, the first one-shot multivibrator 12*a* is adapted so as to output a signal which remains at the Low level for a predetermined period $\tau 2$ after receiving the latch pulse LP. The signal remains at the Low level for a predetermined period $\tau 2$ after receiving the latch pulse LP and then shifts to the High level. The second one-shot multivibrator 12*b* is adapted so as to output a signal which shifts from the Low level to the High level immediately after receiving the latch pulse LP, remains at the High level for a predetermined period $\tau 3$, and then shifts back to the Low level. As a result, the AND circuit 12*d* outputs a scanning pulse output enable signal DOFF as shown in FIG. 12B.

In the circuit configuration shown in FIG. 12A, a switch 12*e* is provided after the AND circuit 12*d* for selecting between the scanning pulse output enable signal DOFF and the power level VCC. A resistor R4 is coupled between the switch 12*e* and the power level VCC. Therefore, in accordance with the LC display device 100 of the present example, it is possible to select between an operation in which the above-mentioned control of the width of the scanning selection pulse is made using the timing control circuit 12 and an operation which does not include such control.

When the timing control circuit 12 having the above configuration receives the latch pulse LP in FIG. 12B at the input of the inverter 12*c*, the scanning pulse output enable signal DOFF in FIG. 12B is output from the two-input AND circuit 12*d*.

The pulse width of the scanning pulse output enable signal during a period between one latch pulse and a next latch pulse (i.e., one horizontal synchronization period) can be controlled based on the time constant defined by the capacitor and the resistors connected to the respective one-shot multivibrators 12*a* and 12*b*.

Specifically, the period $\tau 2$ (i.e., a period after the input of the latch pulse LP until the scanning pulse output enable signal DOFF is active) is determined based on the capacitor C1 and the resistor Rl. The period $\tau 1$ (i.e., a period after the scanning pulse output enable signal DOFF is inactive until a next latch pulse LP is input) is determined based on the capacitor C2 and the resistor R2. Although the timing control circuit 12 shown in FIG. 12A has a simple analog configuration, it will be appreciated that the timing control circuit 12 having the same function can be implemented by a digital logic circuit.

The scanning driver 11 receives the orthogonal function from the function generator 5. In accordance with the latch pulse LP from the controller 6 and the scanning pulse output enable signal DOFF from the timing control circuit 12, the scanning driver 11 applies the "selected" voltage to the electrodes to be selected only while the scanning pulse output enable signal DOFF is active during one horizontal synchronization period, and applies the "unselected" voltage to the electrodes to be selected while the scanning pulse output enable signal DOFF is inactive. At the same time, the scanning driver 11 applies the "unselected" voltage to the unselected electrodes throughout the horizontal synchronization period as in conventional techniques.

The data driver 4 outputs a data signal which has been subjected to the orthogonal transform during one horizontal synchronization period in accordance with the latch pulse LP.

Although the effective value of the voltage applied to the LC is slightly reduced as compared with the applied voltage of the prior art (because of the time period $\tau 1$ and/or $\tau 2$ of the present invention during which the voltage applied to the scanning electrodes is fixed to the unselected potential), the effective value of the applied voltage can be compensated by increasing the "selected" voltage of the scanning driver and/or the voltage corresponding to the data signal, thereby preventing the illuminance of the LC panel from being lowered.

The inventors conducted an experiment in which a VGAn LC panel (response speed: 130 ms) including 640×480 (×a number corresponding to the three primary colors of R, G, and B) pixels was driven while being split into upper and lower halves so as to display an image at a frame frequency of 120 Hz, using the block dispersion driving method under the conditions that the number of block scanning lines was 120 and that the number of simultaneously selected lines within each block was 7. The active period of the scanning pulse output enable signal was set to be the remainder of the horizontal synchronization period excluding a period of about 2 $\mu$s immediately after the input of a latch pulse and a period of about 3 $\mu$s immediately before the input of a next latch pulse. As a result, excellent display quality was obtained.

In order to compensate the effective value of the applied voltage, the amplitude of the scanning voltage and the data voltage to be applied to the LC was increased by several percent.

Usually the inactive period of the scanning pulse output enable signal is determined in view of the capacitance and resistance of the LC panel, the time constant due to the ON resistance of the driver, the length of one horizontal synchronization period, and the like. It is preferable to prescribe the inactive period of the scanning pulse output enable signal to be in the range of about 10% to about 20% of one horizontal synchronization period, in view of the slight decrease in the effective value of the applied voltage. The main reasons for this are described below.

In the case of driving the above-mentioned VGA panel according to the present example, the effective voltage has the following ON/OFF ratio (or "driving margin"):

$$\frac{V\text{on(rms)}}{V\text{off(rms)}} = \sqrt{\frac{(1-b)a^2 + 2a(1-b) + 252}{(1-b)a^2 - 2a(1-b) + 252}} \tag{2}$$

In the above equation, it is assumed that the bias ratio is 1/a, and that the scanning selection pulse is fixed to the "unselected" potential during a period equal to b×100% of the conventional pulse width. The ON/OFF ratio takes the theoretical maximum value (about 6.5%) under the optimum bias when $a=\sqrt{252}$ and b=0.

Assuming that b is increased to 0.15 in the above state, the ON/OFF ratio is derived from eq.2 to be about 6.0%, indicating a decrease of about 10%. Specifically, the effective voltage for the ON pixels decreases by about 4%, and the effective voltage for the OFF pixels decreases by about 3.5%.

If the voltage applied to the LC is universally increased by 4% (equivalent to the decrease in the effective voltage for the ON pixels), for example, the effective voltage for the ON pixels takes the legitimate value but the effective voltage for the OFF pixels takes a value higher than the legitimate value. Therefore, the decrease in the ON/OFF ratio due to the inactive period(s) of the scanning pulse output enable signal cannot be corrected by adjusting the effective value of the voltage applied to the LC.

Thus, it will be seen that there is no substantial decrease in contrast due to the slight decrease in ON/OFF ratio when the inactive period of the scanning pulse output enable signal is in the range of about 10% to about 20% of one horizontal synchronization period, although an excessively large value of b would invite problems such as low contrast and crosstalk.

Considering the breakdown voltage and the power consumption of actual driver ICs for driving the LC, the increase in voltage resulting from the operation should be contained within about 10% of the conventional level.

Thus, in accordance with an LC display device of the present example, the points in time at which the level of the scanning selection pulse changes are slightly shifted with respect to the legitimate or conventional output timing. Specifically, a time shift is adopted at the falling edge of the scanning selection pulse so as to ensure that the scanning selection pulse (which inevitably includes some waveform distortion due to the time constant of the LC panel and the like) fits within the appropriate selected period, and furthermore the waveform of the scanning selection pulse is maintained by ensuring that any induction from the segment side (i.e., the data electrode side) appears during unselected periods of the scanning electrodes. As a result, the advantages of the dispersion type MLS driving method, e.g., high contrast obtained with relatively small-scale circuitry are attained while preventing display quality problems inherent in the dispersion type MLS driving method, thereby obtaining a uniform and beautiful image display.

Although the above example illustrated a case where the scanning selection pulse applied to the scanning electrodes as a scanning voltage is fixed to the "unselected" voltage during both a first period (from the beginning of the output of data until a predetermined time later) and a second period (from a predetermined short time before the completion of the output of data until the completion of the output of data), it is also possible to fix the scanning selection pulse to the "unselected" voltage only during either the first or second period.

For example, by fixing the scanning selection pulse applied to the scanning electrodes to the "unselected" voltage during the second period (from a predetermined short time before the completion of the output of data until the completion of the output of data) in the data voltage output period, any waveform distortion occurring at the falling edge of the scanning selection pulse is prevented from being applied to the scanning electrode longer than it should properly be applied, thereby preventing the double-image phenomenon inherent in the dispersion MLS driving method. On the other hand, by fixing the scanning selection pulse applied to the scanning electrodes to the "unselected" voltage during the first period (from the beginning of the output of data until a predetermined time later) in the data voltage output period, it becomes possible to prevent the change in potential of the data electrode from affecting the rise and fall of the scanning selection pulse, thereby preventing the generation of a horizontal zone (corresponding to the number of selected scanning electrodes) of unevenness in illuminance relative to the other electrodes.

Although the dispersion MLS method was described in the above example, the present invention is also effective for any driving method that uses an orthogonal function for a simple matrix type display device, e.g., the AA method and the non-dispersion MLS method.

As described above, in accordance with a method for driving a display device of the present invention, a data voltage, corresponding to values obtained by subjecting the input data to the orthogonal transform, is supplied to the data electrodes and a scanning voltage, corresponding to an orthogonal function used for the orthogonal transform, is supplied to the scanning electrodes so that the input data is reproduced by the display panel after being subjected to an orthogonal inverse transform. The scanning selection pulse applied to the scanning electrodes as a scanning voltage is fixed at the "unselected" voltage during a first period (from the beginning of the output of data until a predetermined time later) or a second period (from a predetermined short time before the completion of the output of data until the completion of the output of data) in the data voltage output period, or both the first and second periods. As a result, the advantages of the dispersion type MLS driving method, e.g., high contrast obtained with relatively small-scale circuitry, are attained while preventing display quality problems inherent in the dispersion type MLS driving method, e.g., the double-image phenomenon and a horizontal zone (corresponding to the number of selected scanning electrodes) of unevenness in illuminance.

Thus, by fixing the scanning selection pulse applied to the scanning electrodes to the "unselected" voltage during a second period (from a predetermined short time before the completion of the output of data until the completion of the output of data) in the data voltage output period, any waveform distortion occurring at the foot of the falling edge of the scanning selection pulse is prevented from being applied to the scanning electrode longer than it should properly be applied, thereby preventing the double-image phenomenon inherent in the dispersion MLS driving method.

Moreover, by fixing the scanning selection pulse applied to the scanning electrodes to the "unselected" voltage during a first period (from the beginning of the output of data until a predetermined time later) in the data voltage output period, it becomes possible to prevent the change in potential of the data electrode from affecting the rise and fall of the scanning selection pulse, thereby preventing the generation of a horizontal zone (corresponding to the number of selected scanning electrodes) of unevenness in illuminance relative to the other electrodes.

An LC display device according to the present invention includes a timing control circuit which receives a synchronization signal defining the timing for outputting a data voltage from a data driver and outputs a control signal for fixing the potential of the scanning electrode at the "unselected" voltage during a first period (from the beginning of the output of data until a predetermined time later) or a second period (from a predetermined short time before the completion of the output of data until the completion of the output of data) in the data voltage output period as defined by the synchronization signal, or both the first and the second periods. The control signal from the timing control circuit controls a scanning driver to output a scanning selection pulse during each data voltage output period such that the scanning selection pulse is shorter than this period. As a result, display quality problems inherent in the dispersion type MLS driving method, e.g., the double-image phenomenon and a horizontal zone (corresponding to the number of selected scanning electrodes) of unevenness in illuminance are prevented.

As a result, the advantages of the dispersion type MLS driving method, e.g., high contrast obtained with relatively small-scale circuitry, are attained while preventing display quality problems inherent in the dispersion type MLS driving method, thereby obtaining a uniform and beautiful image display having excellent contrast.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A method for driving a simple matrix type display device including a display panel having a plurality of scanning electrodes and a plurality of data electrodes intersecting each other, and a matrix of pixels located at the respective intersections of the plurality of scanning electrodes and the plurality of data electrodes, the method comprising the steps of:

applying a data voltage to the plurality of data electrodes, the data voltage corresponding to values obtained by performing an orthogonal transform of input data;

applying a scanning voltage to the scanning electrodes, the scanning voltage corresponding to an orthogonal function used for the orthogonal transform; and reproducing the input data by performing an orthogonal inverse transform of the data voltage on the display panel, wherein the step of applying the scanning voltage includes the steps of:

applying a scanning selection pulse signal which has at least two levels to the plurality of scanning electrodes as a scanning voltage; and fixing the scanning selection pulse signal to an unselected level during a first period, a second period, or both of the first and second periods, the first period being defined as a period from the beginning of the output of the data until a predetermined time later in a data voltage output period during which the data voltage is output to each of the data electrodes, and the second period being defined as a period from a predetermined short time before the completion of the output of data until the completion of the output of data in the data voltage output period.

2. A liquid crystal display device comprising:

a display panel having a plurality of scanning electrodes and a plurality of data electrodes intersecting each other and a matrix of pixels located at the respective intersections of the plurality of scanning electrodes and the plurality of data electrodes;

a data driver for applying a data voltage to the plurality of data electrodes, the data voltage corresponding to values obtained by performing an orthogonal transform of input data;

a scanning driver for applying a scanning voltage to the plurality of scanning electrodes, the scanning voltage corresponding to an orthogonal function used for the orthogonal transform; and a timing control circuit for receiving a synchronization signal which defines timing of outputting the data voltage from the data driver and for outputting a control signal which fixes the potential level of the scanning electrode at an unselected level during a first period, a second period, or both of the first and second periods, the first period being defined as a period from the beginning of the output of data until a predetermined time later in a data voltage output period which is determined by the synchronization signal, and the second period being defined as a period from a predetermined short time before the completion of the output of data until the completion of the output of data in the data voltage output period, wherein the control signal output from the timing control circuit controls the scanning driver to output a scanning selection pulse during each data voltage output period so that a pulse width of the scanning selection pulse is shorter than the data voltage output period.

3. A liquid crystal display device according to claim 2, wherein the scanning selection pulse has at least two selected levels and the unselected level, and the scanning driver outputs one of the levels of the scanning selection pulse based on the orthogonal function used for the orthogonal transform, in accordance with the output timing of the corresponding data voltage from the data driver, and the scanning driver fixes the currently output scanning selection pulse to the unselected level, based on the control signal from the timing control circuit and independently of the outputting of the scanning selection pulses.

4. The method of claim 1, wherein the first period is in a range of 10% to 20% of the data voltage output period.

5. The method of claim 1, wherein the second period is in a range of 10% to 20% of the data voltage output period.

6. The method of claim 1, further comprising adjusting a level of the scanning voltage to compensate for the first period.

7. The method of claim 1, further comprising adjusting a level of the data voltage to compensate for the first period.

8. The method of claim 1, further comprising adjusting a level of the scanning voltage to compensate for the second period.

9. The method of claim 1, further comprising adjusting a level of the data voltage to compensate for the second period.

10. The method of claim 1, wherein the method is a multiline selection (MLS) method.

11. A liquid crystal display device according of claim 2, wherein the first period is in a range of 10% to 20% of the data voltage output period.

12. A liquid crystal display device according of claim 2, wherein the second period is in a range of 10% to 20% of the data voltage output period.

13. A liquid crystal display device according of claim 2, further comprising adjusting a level of the scanning voltage to compensate for the first period.

14. A liquid crystal display device according of claim 2, further comprising adjusting a level of the data voltage to compensate for the first period.

15. A liquid crystal display device according of claim 2, further comprising adjusting a level of the scanning voltage to compensate for the second period.

16. A liquid crystal display device according of claim 2, further comprising adjusting a level of the data voltage to compensate for the second period.

17. A liquid crystal display device according of claim 2, wherein the liquid crystal display device is driven by a multiline selection (MLS) method.

* * * * *